US009103514B2

(12) United States Patent
Pitkänen

(10) Patent No.: US 9,103,514 B2
(45) Date of Patent: Aug. 11, 2015

(54) LIGHT STRIPE AND MANUFACTURING OF LIGHT STRIPE

(75) Inventor: Temmo Pitkänen, Espoo (FI)

(73) Assignee: MARIMILS OY, Vantaa (FI)

( * ) Notice: Subject to any disclaimer, the term of this patent is extended or adjusted under 35 U.S.C. 154(b) by 313 days.

(21) Appl. No.: 13/636,615

(22) PCT Filed: Mar. 22, 2011

(86) PCT No.: PCT/FI2011/050241

§ 371 (c)(1),
(2), (4) Date: Sep. 21, 2012

(87) PCT Pub. No.: WO2011/117468

PCT Pub. Date: Sep. 29, 2011

(65) Prior Publication Data

US 2013/0010469 A1 Jan. 10, 2013

(30) Foreign Application Priority Data

Mar. 23, 2010 (FI) ..... 20105289 U
Sep. 9, 2010 (FI) ..... 20105938 U

(51) Int. Cl.

| | |
|---|---|
| ***F21V 1/00*** | (2006.01) |
| ***F21S 4/00*** | (2006.01) |
| *F21Y 101/02* | (2006.01) |
| *F21V 5/02* | (2006.01) |
| *F21Y 103/00* | (2006.01) |

(52) U.S. Cl.

CPC .. *F21S 4/006* (2013.01); *F21V 5/02* (2013.01); *F21Y 2101/02* (2013.01); *F21Y 2103/003* (2013.01); *Y10T 29/49146* (2015.01)

(58) Field of Classification Search

CPC ..... F21S 2/00; F21S 11/00; F21S 4/006; F21V 1/00; F21V 5/02; F21Y 2101/00; F21Y 2103/00; F21Y 2101/02; F21Y 2103/003; F21K 9/50

USPC ..... 362/235, 311.02

See application file for complete search history.

(56) References Cited

U.S. PATENT DOCUMENTS

| | | | | |
|---|---|---|---|---|
| 5,193,895 | A | 3/1993 | Naruke et al. | |
| 5,848,837 | A | 12/1998 | Gustafson | |
| 6,505,955 | B1 * | 1/2003 | Hatjasalo et al. | 362/235 |
| 7,559,672 | B1 | 7/2009 | Parkyn et al. | |
| 2009/0154156 | A1 | 6/2009 | Lo et al. | |
| 2009/0296382 | A1 | 12/2009 | Maier | |
| 2013/0201654 | A1 * | 8/2013 | Pickard | 362/84 |

FOREIGN PATENT DOCUMENTS

| | | | |
|---|---|---|---|
| CN | 201045451 | Y | 4/2008 |
| CN | 201053600 | Y | 4/2008 |

(Continued)

*Primary Examiner* — Anh Mai
*Assistant Examiner* — Jessica M Apenteng
(74) *Attorney, Agent, or Firm* — Birch, Stewart, Kolasch & Birch, LLP

(57) ABSTRACT

Light stripe (101), comprising an elongated elastic circuit board (102) and electrical components connected to it, which comprise at least light-emitting components (103), and a transparent insulation material layer at least on the side of the circuit board that contains electrical components, and in which a lens structure (105) elongated in the direction of the light stripe is arranged in the insulation material layer for directing the light.

12 Claims, 4 Drawing Sheets

(56) References Cited

FOREIGN PATENT DOCUMENTS

Figure 1:
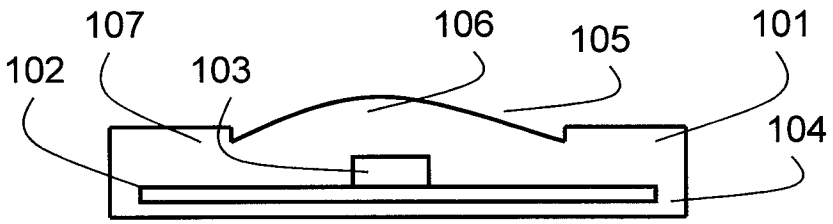

| | | | |
|---|---|---|---|
| CN | 201277466 | Y | 7/2009 |
| DE | 10 2008 009 808 | A1 | 8/2009 |
| EP | 0 760 448 | A2 | 3/1997 |
| WO | WO 98/23896 | A1 | 6/1998 |

* cited by examiner

LIGHT STRIPE AND MANUFACTURING OF LIGHT STRIPE

FIELD OF TECHNOLOGY

The object of the current invention is a light stripe and the manufacturing of same. More particularly the object of the invention is a LED light stripe, which comprises an elongated elastic circuit board, to which LEDs (Light Emitting Diode) are connected at regular intervals, and which comprises an insulation layer of a plastic material.

PRIOR ART

LED light stripes or LED photoconductors are used e.g. to guide the passage of people in various premises, e.g. at airports or in hospitals. They are generally disposed on the floor, and the LEDS comprised in them can be controlled to flash, to run or in some other such desired manner so that the desired guidance function is achieved. Monochromatic LEDs or polychromatic LEDs, e.g. RGB LEDs, can be used in LED light stripes. This type of light stripe can be manufactured in a continuous manufacturing process, such as by extrusion or corresponding. The components used in a light stripe are connected to a thin elastic circuit board with surface-mounting technology. In prior-art LED light stripes light is typically spread upwards from the plane of the circuit board at an angle of approx. 120°. A drawback in these types of prior-art LED light stripes is that the light cannot be directed e.g. to the side.

Also known in the art are solutions wherein a light stripe comprises a lens on top of light-emitting elements. For example U.S. Pat. No. 5,193,895 presents a warning light arrangement, wherein light-emitting elements are connected to a flexible printed circuit board (PCB), and wherein on top is a separate lens part, e.g. of silicon, to be cast as a separate lens part into an aperture in a frame part of rubber-like material. Yet another drawback in these types of prior-art lens solutions, in addition to the aforementioned drawbacks, is the complex manufacturing process they require, because the frame part and the lens part to be cast into the apertures in it must be manufactured in different manufacturing processes.

One drawback in prior-art solutions is also that a light stripe formed from light sources does not produce an even light.

SUMMARY OF THE INVENTION

The purpose of this invention is to eliminate the drawbacks of prior art and to achieve an entirely new kind of light stripe, wherein the lens structure in front of the light-emitting elements is formed directly in the insulating material in its manufacturing phase, in which case the lens can be made in the same continuous manufacturing process as also the other insulation material of the stripe. In this way extra manufacturing phases can be avoided, and a very tight structure is obtained from a light stripe according to the invention, in which structure all the insulation layer on top is formed from unbroken insulator material, in which case the lens is thus in the same insulator material.

According to one embodiment of the invention there can be a surface comprising a mirror-like material in the light stripe. By means of this light-reflecting surface the light formed by the light sources, which light reflects onto the mirror-like surface from the inside surface of the insulation material by means of total reflection, reflects from the mirror-like surface strongly into the environment. Thus the impression of the light is more even than in a light stripe that does not comprise a mirror-like surface.

The characteristic features of the light stripe and its manufacturing method according to the invention are described in detail in the independent claims below and preferred embodiments in the other claims. A light stripe can also be called a photoconductor.

SHORT DESCRIPTION OF THE DRAWINGS

Figure 2:
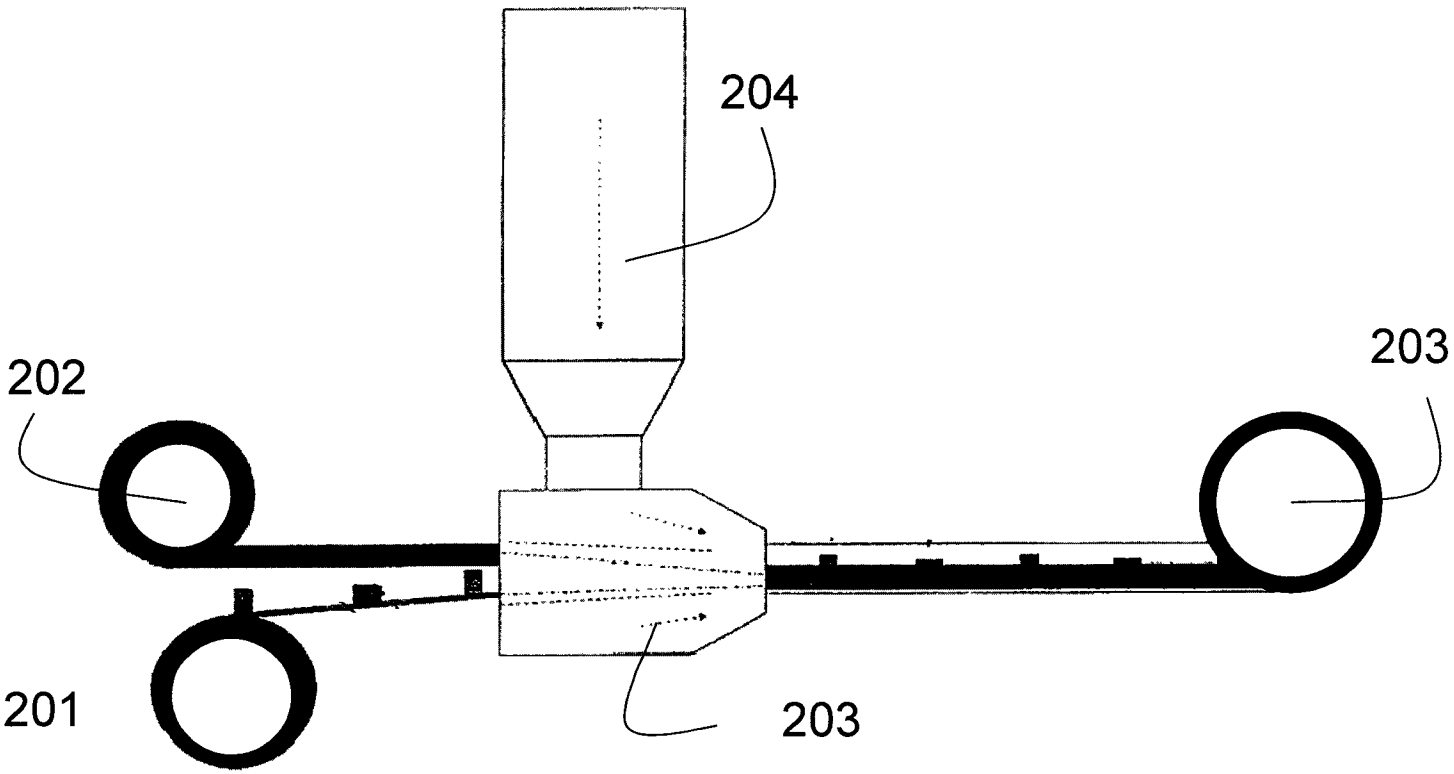
Figure 3:
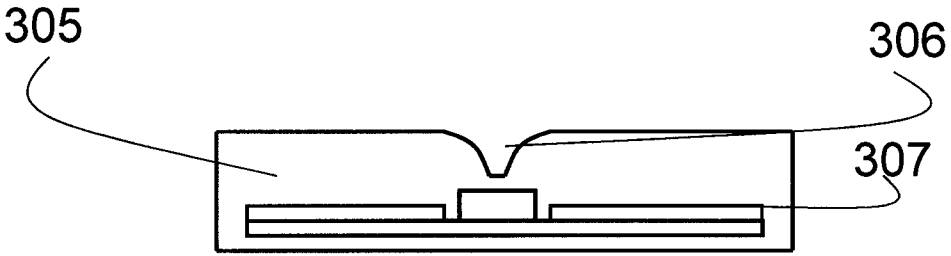
Figure 4:
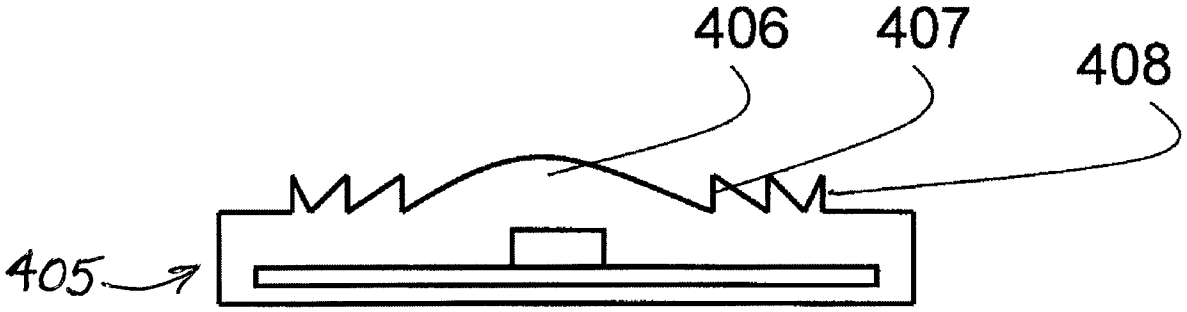

In the following, the invention will be described in more detail by the aid of some examples of its embodiments with reference to the attached drawings, wherein FIG. 1 presents one light stripe according to the invention as a perspective sketch and sectioned at the end, FIG. 2 presents in diagrammatic and simplified form the manufacturing of a light stripe according to the invention, FIG. 3 presents a second light stripe according to the invention as a perspective sketch and sectioned at the end, FIG. 4 presents yet another light stripe according to the invention as a perspective sketch and sectioned at the end.

DESCRIPTION OF SOME EMBODIMENTS OF THE INVENTION

FIG. 1 presents a flat LED light stripe 101, which is used e.g. to guide the passage of people in various premises, e.g. at airports or in hospitals. It is typically approx. 20 mm in width and approx. 4-5 mm in thickness. It contains in the center a thin elastic circuit board 102, which consists of a stripe of an elastic plastic material and of copper wiring made on top of the stripe e.g. by etching or printing. LEDS 103 are connected to the circuit board at regular intervals, and in addition to that other components e.g. resistors (not shown) for controlling and protecting the LEDS. The LEDs can be monochromatic or polychromatic, and the desired guidance function can be obtained with them by controlling them to flash, to run, et cetera. The circuit board and the components connected to it are surrounded with a plastic, e.g. polyethylene, transparent envelope part 104 around them such that a fully waterproof LED light stripe, typically of protection class IP68, is obtained.

The light stripe according to the invention comprises a lens structure 105 in the longitudinal direction of the stripe arranged on the top surface of the envelope part 104, which lens structure can according to FIG. 1 comprise a simple convex lens 106 in the center and flat parts 107 on the sides, in which case the light leaving the LEDs is directed with the lens 106 upwards vertically and at a right angle with respect to the plane of the circuit board. Thus the light can be made to be very clearly visible e.g. directly upwards from a light stripe disposed on the floor.

The stripe element is manufactured in a continuous manufacturing process, such as with an extrusion process from reel to reel with an apparatus according to FIG. 2. The electrical components 103 are first fixed with surface-mounting technology to the elastic circuit board 102, which comes from the reel 201, at regular intervals for the whole length of the stripe element. After that the structure is surrounded with a plastic envelope material 104, which comes from a second reel 202, in an extrusion press 204, after which the light stripe obtained is guided onto a storage reel 203.

The extrusion press comprises a nozzle part 205 that enables a lens surface according to the invention, e.g. according to FIG. 1, which nozzle part thus shapes the envelope part surrounding the circuit board such that a lens structure according to FIG. 1 is produced in it on top of the circuit board and in the envelope part in front of the LEDs.

With this method it is possible to manufacture a number of parallel stripe parts in the same process and in the same preform, which stripe parts can then be cut apart from each other after the phases presented in the preceding and guided onto a reel. The electrically-conducting coating of the circuit board can, before extrusion, be coated e.g. with a masking color or masking tape 307.

According to one embodiment of the invention there can be a surface comprising an essentially mirror-like material in place of a masking color or masking tape 307. A mirror-like surface means a surface that reflects most of the light coming to it. A mirror-like surface can be formed e.g. from a thin metal film, from plastic or from other material that acts like a mirror as a reflecting surface. In this case the light formed by the light sources, which light reflects onto the mirror-like surface from the inside surface of the envelope part by means of total reflection, reflects from the mirror-like surface strongly into the environment. Thus the impression of the light is more even than in a light stripe that does not comprise a mirror-like surface.

According to one embodiment of the invention the surface to be formed on top of the coating of the circuit board can also be a combination of a masking color or masking tape and an essentially mirror-like surface.

It is obvious to the person skilled in the art that the different embodiments of the invention are not limited solely to the examples described above, but that they may be varied within the scope of the claims presented below. The lens structure is not limited to the embodiment described above, but instead it can also be a structure 305 that deflects light to the side according to FIG. 3, which comprises flat surface parts on the sides and a recess 306 in the center that deflects light. Particularly when using harder plastic materials, the lens structure of the envelope can also form e.g. a Fresnel lens structure 405 according to FIG. 4, in which case the top surface of the envelope part comprises dioptric lens parts 406, 407 in the center and catadioptric prism parts 408 on the edges. A lens can also be formed on the edge of a stripe, and in addition to that the envelope can be coated at the point of the lens for improving the deflection properties.

The invention claimed is:

1. A light stripe (101), comprising:

an elongated elastic circuit board (102), electrical components connected to the elongated elastic circuit board (102) including at least light-emitting components (103), a transparent insulation material layer (104) at least on a side of the circuit board (102) that contains the electrical components, and a lens structure (105) elongated in the direction of the light stripe (101) arranged in the insulation material layer (104) for directing light, wherein the light stripe (101) is manufactured with a continuous manufacturing process, and the lens structure (105), which includes at least one convex lens (106), is arranged on a top surface of the insulation material layer (104) and, the at least one convex lens (106) has an outer peripheral edge arranged lower than a flat part (107) of the top surface of the insulation material layer (104).

2. The light stripe according to claim 1, wherein the light stripe (101) is manufactured with a continuous reel-to-reel manufacturing process.

3. The light stripe according to claim 1, wherein the light stripe is flat, and the lens structure (105) is arranged on at least one side surface of the insulation material layer (104).

4. The light stripe according to claim 1, wherein the at least one convex lens (106) is formed with a continuous recess between the outer peripheral edge and the flat part (107) of the top surface of the insulation material layer (104).

5. The light stripe according to claim 1, wherein at least a part of a surface on top of the circuit board comprises a mirrorlike material.

6. A light stripe (101), comprising:

an elongated elastic circuit board (102) including at least light-emitting components (103);

electrical components connected to the elongated elastic circuit board (102);

a transparent insulation material layer at least on a side of the circuit board (102); and a lens structure (305) elongated in a direction of the light stripe (101) arranged in the insulation material layer for directing light, wherein the lens structure (305) includes:

a recess (306) in a central portion thereof, and flat surface parts on opposite sides of the recess (306), wherein the recess deflects light to lateral sides of the lens structure (305) in a direction parallel to the flat surface parts.

7. The light stripe according to claim 6, wherein the light stripe is flat, and the lens structure is arranged on at least one side surface of the insulation material layer.

8. A light stripe (101), comprising:

an elongated elastic circuit board (102) including at least light-emitting components (103);

electrical components connected to the elongated elastic circuit board (102);

a transparent insulation material layer (104) at least on a side of the circuit board (102); and a lens structure (405) elongated in a direction of the light stripe (101) arranged in the insulation material layer (104) for directing light, wherein the lens structure (405) forms a Fresnel lens structure (405), and a top surface of the insulation material layer (104) comprises dioptric lens parts (406, 407) near a perimeter of the lens structure (405), and catadioptric prism parts (408) nearer to outer edges of the insulation material layer (104).

9. The light stripe according to claim 8, wherein the light stripe is flat, and the lens structure is arranged on at least one side surface of the insulation material layer.

10. A method for manufacturing a light stripe, the method comprising:

forming an elongated elastic circuit board (102) of the light stripe (101), connecting electrical components, including at least light-emitting components (103), to an elongated elastic circuit board;

forming a transparent insulation material layer on at least a side of the circuit board (102), containing the electrical components, with a continuous manufacturing process, and arranging the lens structure (105) elongated in a direction of the light stripe on the insulation material layer (104), in connection with forming the insulation material layer (104), for directing the light, the method further comprising:

arranging the lens structure (105), which includes at least one convex lens (106), on a top surface of the insulation material layer (104), and arranging an outer peripheral edge of the at least one convex lens (106) to be lower than a flat part (107) of the top surface of the insulation material layer (104).

11. The method according to claim 10, wherein a plastic coating material (104) is formed on the structure, in which the electrical components are connected to the circuit board, in an extrusion press (204) that comprises a nozzle part (205) enabling a lens surface, which nozzle part shapes the insulating material layer such that the desired lens structure is produced in it.

12. The method according to claim 10, wherein the insulation material layer is formed in a reel-to-reel manufacturing process.

* * * * *